US008778475B2

(12) United States Patent
Joyce et al.

(10) Patent No.: US 8,778,475 B2
(45) Date of Patent: Jul. 15, 2014

(54) PATCH FOR AN UNDERWIRE BRASSIERE

(76) Inventors: Lesa Michelle Joyce, Los Angeles, CA (US); Fredericka Lee Goldstein, Los Angeles, CA (US)

( * ) Notice: Subject to any disclaimer, the term of this patent is extended or adjusted under 35 U.S.C. 154(b) by 441 days.

(21) Appl. No.: 13/092,309

(22) Filed: Apr. 22, 2011

(65) Prior Publication Data

US 2011/0262677 A1 Oct. 27, 2011

Related U.S. Application Data

(60) Provisional application No. 61/327,665, filed on Apr. 24, 2010.

(51) Int. Cl.
*A41C 3/00* (2006.01)
*B32B 7/00* (2006.01)

(52) U.S. Cl.
USPC ..... 428/43; 428/76; 428/91; 428/221; 428/354

(58) Field of Classification Search
USPC ..... 428/43, 91, 221, 76, 354
See application file for complete search history.

(56) References Cited

U.S. PATENT DOCUMENTS

| | | | | |
|---|---|---|---|---|
| 5,669,247 | A | 9/1997 | McCartney | |
| 5,749,767 | A | 5/1998 | Arceo | |
| 6,435,939 | B1 | 8/2002 | Lin | |
| 6,682,395 | B2 | 1/2004 | Falla | |
| 6,695,677 | B1 | 2/2004 | Lin | |
| 6,780,080 | B2 | 8/2004 | Horta | |
| 6,896,580 | B2 | 5/2005 | Falla | |
| 7,189,138 | B1 | 3/2007 | Utaka | |
| 7,207,861 | B2 | 4/2007 | Martini | |
| 7,407,428 | B2 | 8/2008 | Fildan | |
| 7,666,060 | B2 | 2/2010 | Cheung | |
| 7,850,507 | B2 | 12/2010 | Horta | |
| 2005/0235482 | A1 * | 10/2005 | Deaett et al. | 29/600 |
| 2009/0156096 | A1 | 6/2009 | Horta | |
| 2010/0022164 | A1 | 1/2010 | Taylor | |
| 2010/0317256 | A1 | 12/2010 | Zhang | |
| 2010/0317258 | A1 | 12/2010 | Liu | |

* cited by examiner

*Primary Examiner* — Brent O'Hern

(57) ABSTRACT

A patch covers a hole created on a fabric when a wire of an underwire bra breaks through, poking the delicate skin around the breast of a woman. The patch includes an outer layer made of a laminate material, an inner layer made of a close knit material. The outer layer may completely encase the inner layer.

7 Claims, 3 Drawing Sheets

PATCH FOR AN UNDERWIRE BRASSIERE

CROSS-REFERENCE TO RELATED APPLICATIONS

This application claims the benefit of priority to U.S. Provisional Application No. 61/327,665 filed Apr. 24, 2010, the contents of which are incorporated herein by reference.

BACKGROUND OF THE INVENTION

The present invention generally relates to a patch. More specifically, the present invention relates to a patch to cover a hole created when a wire of an underwire brassiere breaks through the fabric.

An underwire bra is a brassiere having a wire built into the underside of the cup intended to lift, separate, shape, and provide additional support for a woman's breasts. Unfortunately, after several uses, the wire has a tendency to break through the fabric in which it is encased, poking the delicate skin around the breast of the woman. This is extremely uncomfortable and often renders the brassiere useless, thereby requiring the woman to purchase a new brassiere.

As can be seen, there is a need to provide a patch to cover the hole created when the wire breaks through the fabric of an underwire bra to prevent the wire from poking the delicate skin around the breast.

SUMMARY OF THE INVENTION

In one aspect of the present invention, a patch for an underwire brassiere or garment includes an outer layer made of a laminate material and an inner layer made of a close knit material. The outer layer may completely encase the inner layer.

In another aspect of the present invention, a patch for an underwire brassiere or garment includes an outer layer made of a laminate material, an inner layer made of a close knit material, a self adhesive material paced on the outer layer, the outer layer may completely encase the inner layer.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a patch to cover a hole created on a fabric when a wire of an underwire bra breaks through, poking the delicate skin around the breast of a woman. In addition, an embodiment of the present invention provides a method of producing the patch.

Figure 1:
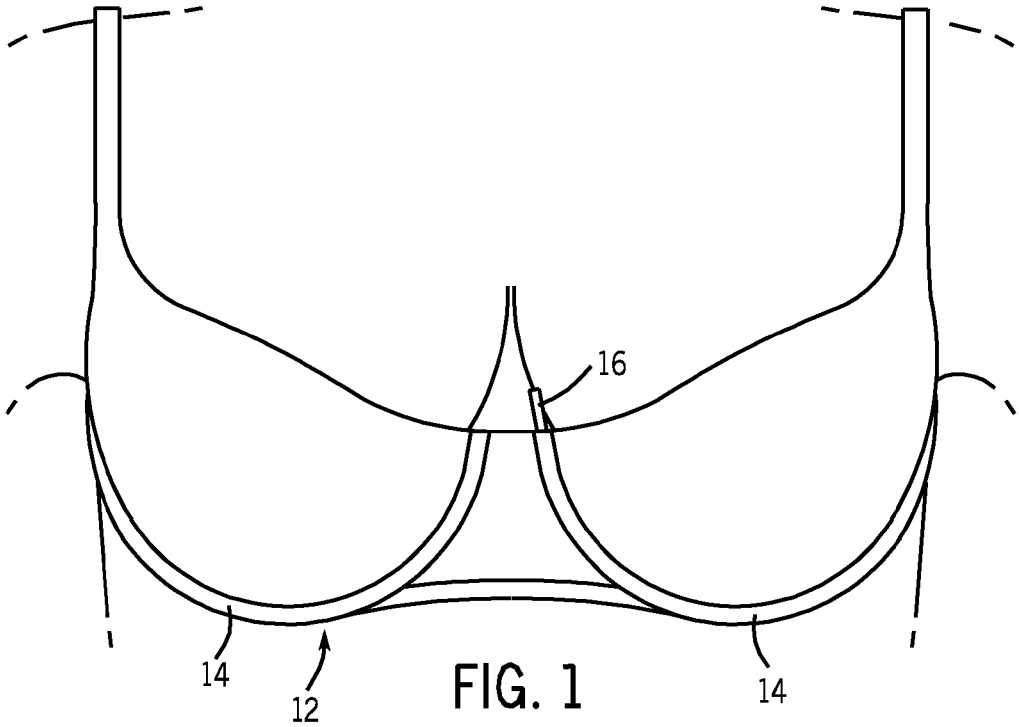
FIG. 1 illustrates a front view of a brassiere showing the wire breaking out of the fabric.

FIG. 1 illustrates an underwire brassiere 12 showing a wire 16 breaking out of the casing 14 on which it is encased.

Figure 2:
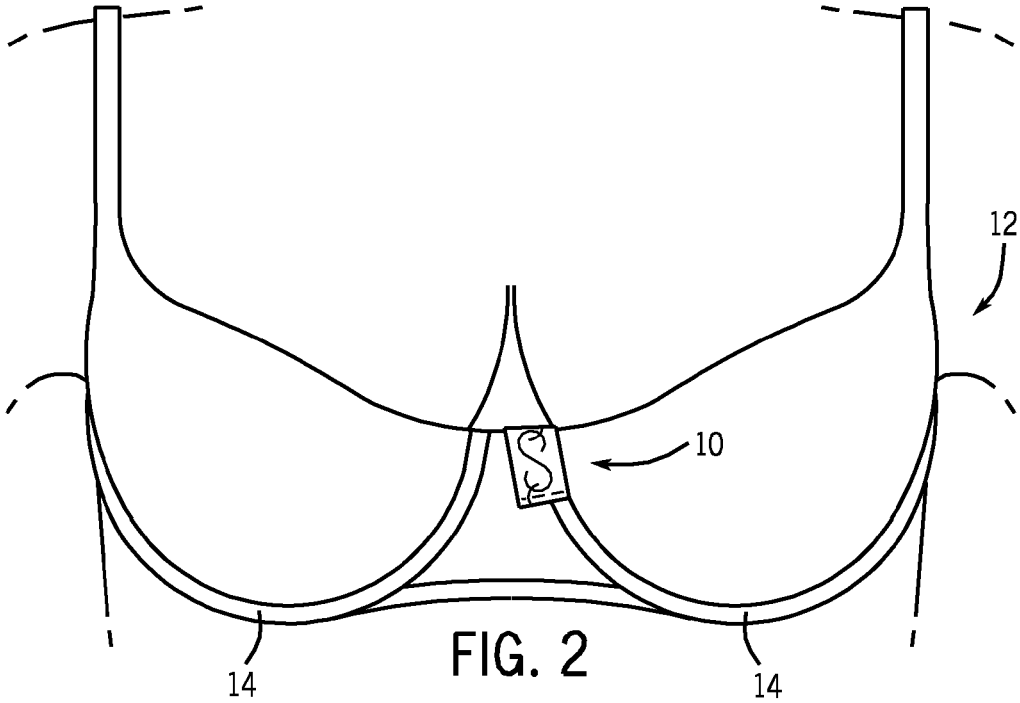
FIG. 2 illustrates a front view of a patch for an underwire showing the patch in working position.

FIG. 2 illustrates a patch 10 for the underwire brassiere 12 showing the patch in working position.

Figure 3A:
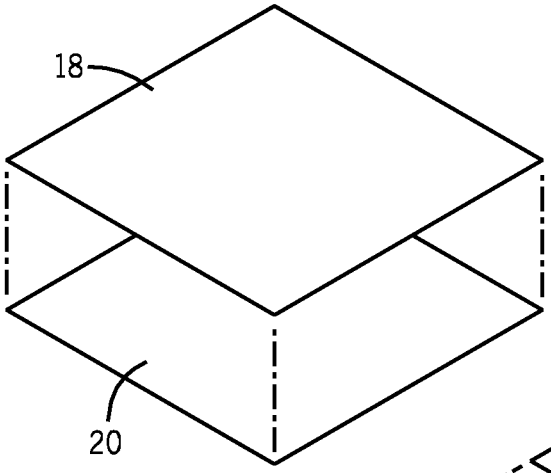
FIGS. 3*a* to 3*b* illustrate schematic views showing the steps in manufacturing an outer layer for the patch according to an exemplary embodiment of the present invention.
Figure 3B:
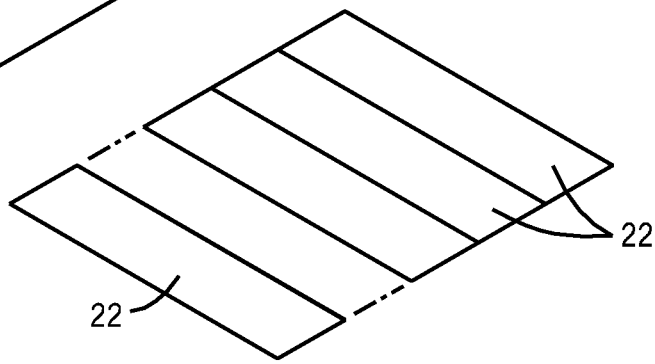
Figure 3C:
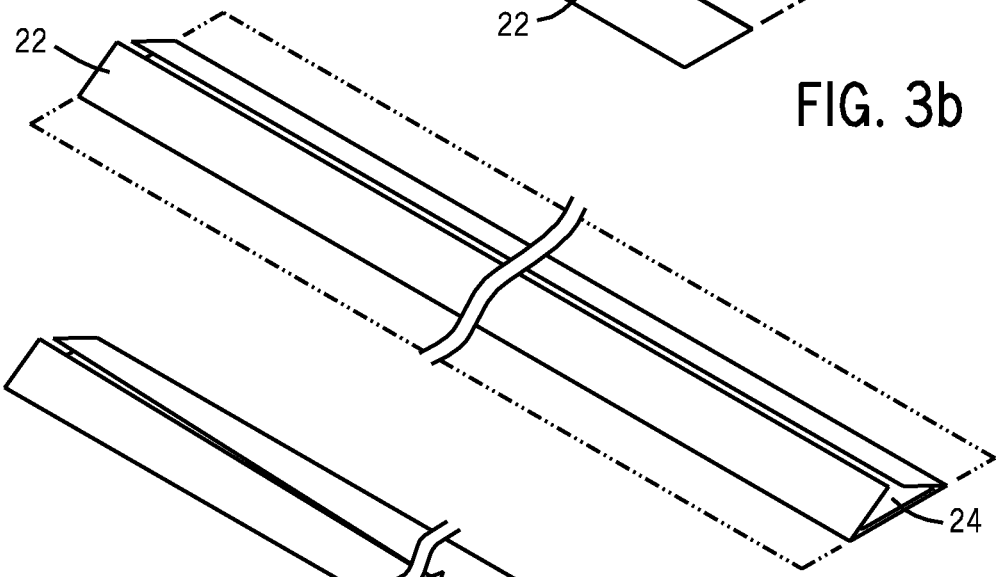
FIGS. 3*c* to 3*e* illustrate schematic views showing the steps in manufacturing the patch according to another exemplary embodiment of the present invention.

FIG. 3*c* illustrates the patch 10 according to an exemplary embodiment of the present invention. The patch 10 may include an outer layer 22 made of a laminate material and an inner layer 24 made of a close knit material. The outer layer 22 may completely encase the inner layer 24.

The outer layer 22 may contact the skin of the user. As can be seen from FIGS. 3*a*-3*b*, the outer layer 22 may be made by laminating a non-abrasive material 18 with an interfacing layer 20. The lamination may add additional strength to the outer layer 22. The non-abrasive material may be made of fabric, nylon, silk, cotton, cloth, brocade, denim, satin, velvet, velveteen, polyester, sateen, polished cotton, rayon, LYCRA, spandex, jersey or knits. The interfacing layer 20 may provide the outer layer 22 with additional strength. The interfacing layer 20 may be a fusible interfacing layer or a sew-in interfacing layer. In some embodiments, the interfacing layer 20 may be made of a fusible woven interfacing or a fusible non-woven interfacing.

The patch 10 may have any geometrical shape. In some embodiments, the shape of the patch 10 may be rectangular, oval, round, square, trapezoidal, parallelogram, hexagonal, or triangular. In some embodiments, the patch 10 may be a long strip. The size of the patch 10 may depend on the size of the underwire brassiere 12 or garment (not shown). In some embodiments, the patch 10 may have a rectangular shape having approximately 2 inches in length and ⅝ inches in width. The patch 10 may have different thickness.

The inner layer 24 may prevent the wire 16 of the underwire brassiere 12 from passing through the patch and penetrating the skin of the user. The close knit material of the inner layer 24 may be non-abrasive plastic, close knit nylon, Betacloth, Teflon, Mylar, Kevlar, baffistic nylon, aramid, denim, canvas, nylon webbing, oilcloth, or other similar fabrics or materials.

Figure 3D:
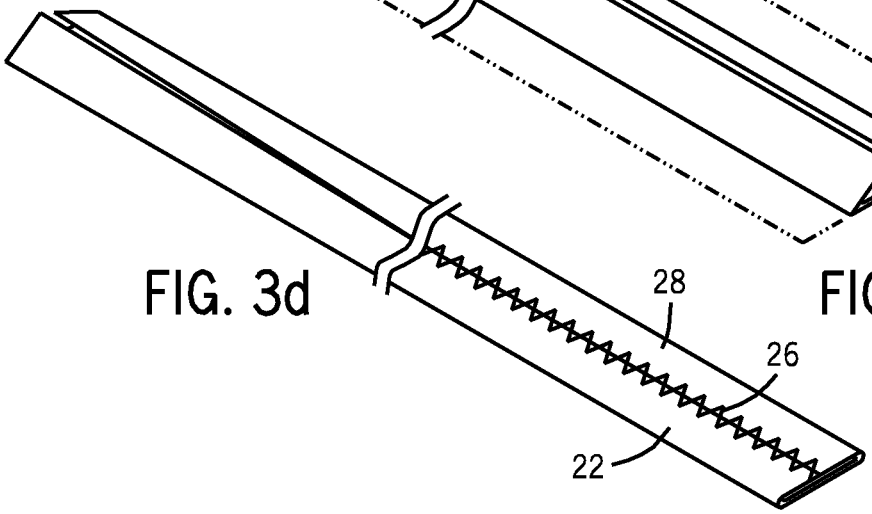
Figure 3E:
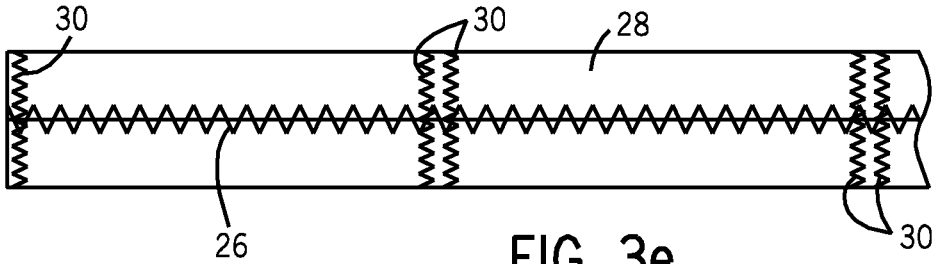

As can be seen on FIGS. 3*d*-3*e*, the outer layer 22 may completely encase the inner layer 24. The longitudinal ends of the outer layer 22 may be folded to the center of the back side 28 of the outer layer 22 to encase the inner layer 24. Then, longitudinal stitches 26 may be sewn through the length of the patch back side 28 of the outer layer 22. The longitudinal stitches 26 may help in locking and securing the inner layer 24 inside the outer layer 22 so no shifting may occur. Cross-side stitches 30 may be sewn at the ends of the back side 28 of the outer layer 22. The cross-side stitches 30 may prevent fraying of the fabric.

The patch 10 may be adhered to the underwire brassiere 12 or garment (not shown) by any method known in the art. In some embodiments, the patch 10 may be adhered to the underwire brassiere 12 or garment (not shown) by gluing, adhesive, sewing, or hot iron application.

Figure 3F:
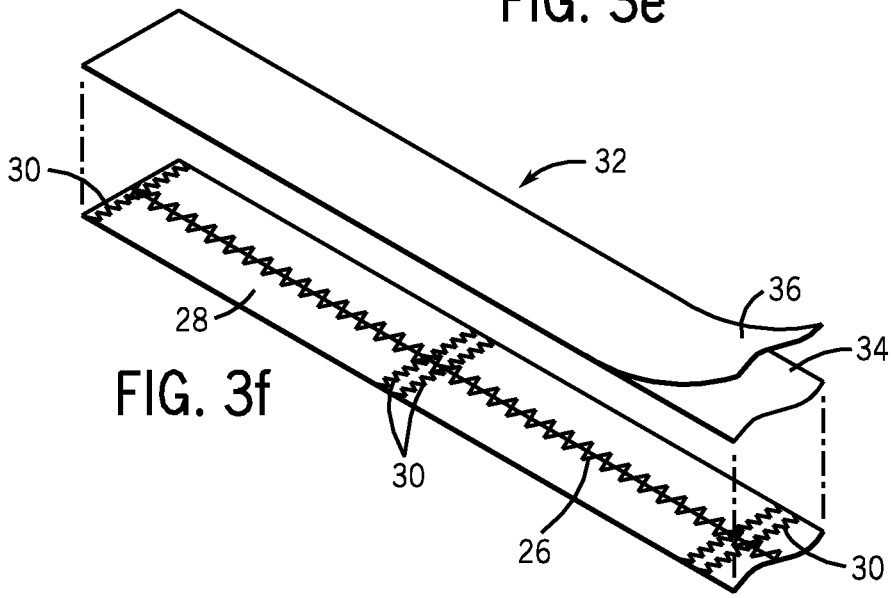
FIG. 3*f* illustrates an exploded view of a patch for an underwire bra according to another embodiment of the present invention.

As can be seen on FIG. 3*f*, a self adhesive material 34 may be placed on the back side 28 of the outer layer 22 of a patch 32. The self adhesive material 34 may help the user to easily apply the patch 10 to the underwire brassiere 12. The self adhesive material 34 may provide the user with the immediate ability to use the patch 10. In addition, the self adhesive material 16 may provide additional strength and protection to the patch 10. A cover 36 may help to protect the self adhesive material 34 until it is time to use it.

Figure 3G:
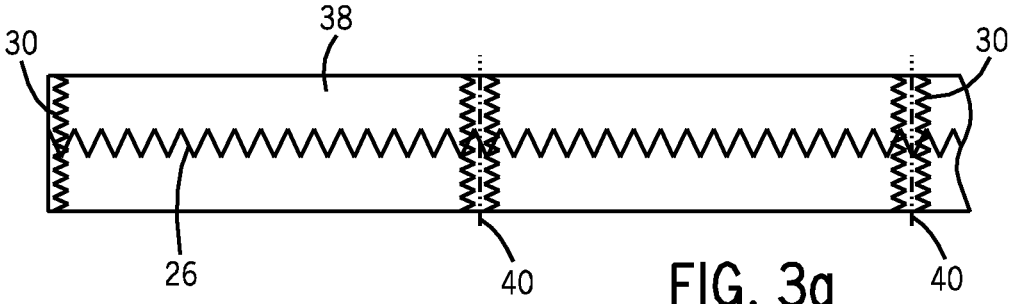
FIG. 3*g* illustrates an exploded view of a patch for an underwire bra according to another embodiment of the present invention.
Figure 4:
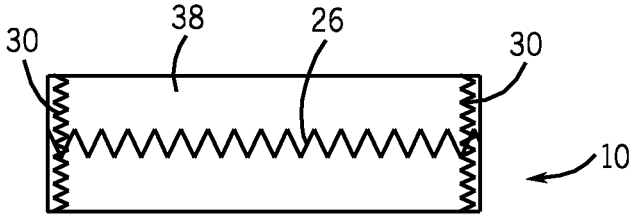
FIG. 4 illustrates a back view of the patch of FIG. 3*g*.

FIG. 3*g* illustrates a patch 38 according to another embodiment of the present invention. The patch 38 may include a pre-cut line 40 to help adjust the size of the patch 38.

In one embodiment, the user may peel the cover 36 of the self adhesive material 34 and then the user may position the patch 10 to cover the hole made by the wire 16 on the casing 14 of the underwire brassiere 12 or garment (not shown). Then, the user may press the patch 10 firmly into place.

At least one additional inner layer of material (not shown) may be added to the patch 10 to prevent the pass of the wire through the patch 10. In some embodiments, the additional inner layer (not shown) may be made of non-abrasive plastic, close knit nylon, Betacloth, Teflon, Mylar, Kevlar, ballistic nylon, aramid, denim, canvas, vinyl webbing, oilcloth, or other similar fabrics or materials.

Jewels, feathers, appliques, or decorative items may be applied to the patch 10 for decorative purposes.

In some embodiments, the patch 10 may be folded either: 1) widthwise and the edges of the fold sewn together creating a pocket to capture the wire 16 or 2) lengthwise by stitching of the top of the fold creating another type of enclosure that captures the wire 16. In this embodiment, the patch 10 may create a barrier between the skin of the user and the broken wire 16. The patch 10 may be constructed to provide a free small edge around the self-adhesive material 34 to sew the patch 10 onto the underwire brassiere 12 for permanency.

It should be understood, of course, that the foregoing relates to exemplary embodiments of the invention and that modifications may be made without departing from the spirit and scope of the invention as set forth in the following claims.

We claim:

1. An underwire brassiere patch or garment patch for a garment which contains underwire or boning, comprising of an outer layer made of material including: nylon, silk, cotton, cloth, brocade, denim, satin, velvet, velveteen, polyester, sateen, polished cotton, rayon, spandex, jersey, or knits; an inner layer made of plastic, nylon, beta cloth, polytetrafluoroethylene (PTFE), polyethylene terephthalate (PET), polyparaphenylene terephthalamide, ballistic nylon, aramid, denim, canvas, vinyl webbing, or oilcloth; and an adhesive layer and wherein the outer layer may overlap to completely encase the inner layer.

2. The patch according to claim 1, wherein the outer layer is fused or sewn to an interfacing layer.

3. The patch according to claim 1, wherein the patch has a rectangular shape.

4. The patch according to claim 1, further including longitudinal stitches through a length of the patch.

5. The patch according to claim 1, further including cross-side stitches through the ends of the patch.

6. The patch according to claim 1, further including at least one pre-cut line.

7. A patch according to claim 1, wherein an adhesive layer is applied on the overlapping side of the outer laminate layer.

* * * * *